United States Patent [19]

Riches et al.

[11] Patent Number: 4,550,967

[45] Date of Patent: Nov. 5, 1985

[54] ELECTRICAL CONNECTOR MEMBER

[75] Inventors: Arthur J. Riches, Herne Bay; Brian Mitchell, Canterbury, both of England

[73] Assignee: Allied Corporation, Morris Township, Morris County, N.J.

[21] Appl. No.: 447,739

[22] Filed: Dec. 8, 1982

[30] Foreign Application Priority Data

Dec. 14, 1981 [GB] United Kingdom ..... 8137686

[51] Int. Cl.[4] ..... H01R 13/62

[52] U.S. Cl. ..... 339/88 R

[58] Field of Search ..... 339/91 R, 91 B, 88 R, 339/90 R, 90 C, DIG. 2, 19, 21 R

[56] References Cited

U.S. PATENT DOCUMENTS

| | | | |
|---|---|---|---|
| 839,297 | 12/1906 | Kennedy et al. . | |
| 932,869 | 8/1909 | Johnson . | |
| 1,369,687 | 2/1921 | Martin . | |
| 1,818,819 | 8/1931 | Seresun . | |
| 1,829,255 | 10/1931 | Ballou . | |
| 2,062,424 | 12/1936 | Mueller . | |
| 2,234,745 | 3/1941 | Von Rarrel | 339/91 R |
| 2,363,436 | 11/1944 | Pancoe | 339/91 R |
| 2,427,681 | 9/1947 | Lombard | 285/349 |
| 2,431,268 | 11/1947 | McIntyre | 285/317 |
| 2,660,457 | 11/1953 | Mallon | 315/403 |
| 2,761,111 | 8/1956 | Klostermann . | |
| 2,898,130 | 8/1959 | Hansen . | |
| 2,898,616 | 8/1959 | Coover . | |
| 3,121,599 | 2/1964 | Modrey . | |
| 3,312,928 | 4/1967 | Nava et al. . | |
| 3,403,930 | 10/1968 | Bernier . | |
| 3,455,580 | 7/1969 | Howard . | |
| 3,643,988 | 2/1972 | Ingvartsen . | |
| 3,680,033 | 7/1972 | Kawai . | |
| 4,190,308 | 2/1980 | Iantorno | 339/19 |
| 4,359,253 | 11/1982 | Iantorno | 339/19 |

FOREIGN PATENT DOCUMENTS

| | | | |
|---|---|---|---|
| 672954 | 11/1966 | Belgium | 339/88 R |
| 1045762 | 12/1953 | France | 339/88 R |
| 1383119 | 11/1964 | France | 339/88 R |
| 2078601 | 10/1971 | France | 339/88 R |
| 1403093 | 8/1975 | United Kingdom | 339/88 R |
| 2063587 | 6/1981 | United Kingdom | 339/88 R |

*Primary Examiner*—William R. Briggs

*Attorney, Agent, or Firm*—Roger H. Criss; Roy H. Massengill

[57] ABSTRACT

A push-on pull-off connector member 30 for coupling to a standard bayonet receptacle 10 has three equispaced circumferential slots 36 for receiving the bayonet pins 20 of the receptacle 10. Spring rings 40 in circular recesses 38 opening into the slots 36 from each side retain the pins 20. The recesses 38 are easily formed, for example, by milling. The coupled connector resists a weak uncoupling force but separates under a strong force, and can provide a snatch-disconnect facility.

In alternative embodiments, each slot 36 has a single circular ring (FIG. 6), two spring rings are formed at each end of a single member (FIG. 4), the rings have inwardly-directed tangs for ease of fitting and removal (FIG. 5), or the spring rings are parts of question-mark shaped members (FIG. 7).

12 Claims, 7 Drawing Figures

ELECTRICAL CONNECTOR MEMBER

BACKGROUND OF THE INVENTION

This invention relates to an electrical connector member of the type comprising a generally cylindrical shell member forming a housing for one or more electrical contacts and being provided with means for retaining the connector member on a mating connector member which carries two or more radial bayonet pins.

A large number of bayonet connectors are in use for many applications. Bayonet connectors comprise two or more radial pins on one connector member and two or more corresponding recesses or slots in the other connector member. Usually the recesses or slots have an axial portion, one end of which is open at the front edge of the connector member, and a circumferential portion communicating with the other end of the axial portion. Thus the coupling operation involves two movements, first axial push, followed by a partial rotation. The pins then move into the circumferential portion of the recesses or slots and are retained there against a resilient bias. This bias is usually directed in the axial direction and forces the pins into a relieved portion on the outer side of this section of the recess or slot. The uncoupling operation involves first a rotation and then axial movement to separate the connector members.

There exists a need in some circumstances to upgrade the operational requirements of existing bayonet connectors. If used, for example, to connect a motorcyclist's headphones to a transceiver on the cycle, a conventional bayonet connector can be dangerous in that it will not disconnect in an accident where the cyclist is thrown clear of his machine. There is thus a need for a simple and effective snatch disconnect mechanism. Since large numbers of bayonet connector members carrying the pins already exist, it would be highly desirable to achieve this while using the existing bayonet pin connector members.

There may also be instances where a simpler connection procedure is required avoiding the need for a push (usually against a spring) followed by a rotation.

British Patent Specification GB-PS No. 2063587A describes a quick release connector for use with bayonet pins. However, before uncoupling can take place, a degree of rotary movement is required in the mechanism. In particular, a rotary latch member (15) needs to be rotated around the shell member. This can cause problems in field use where dust and dirt can impede the mechanism, or where the shell is likely to be dented, and makes it potentially unreliable and hence possibly dangerous.

British Patent GB-PS No. 1403093 describes an alternative solution to the problem which does not have this disadvantage. In this instance a U-shaped spring clip or "spring link" is arranged in the surface of the shell member with its converging arms extending towards the end of the connector member. The bayonet pin of an associated connector member can pass between the converging ends of the spring clip to be retained within the U-shaped clip.

Fabrication of such a structure is difficult as the U-shaped clip requires the machining of a relatively complex shape in the periphery of the shell member. In practice therefore the shell member has to be formed by casting, and subsequent machining of the casting is difficult.

It would be desirable to provide a push/pull connector which solves the above problems in an effective manner.

SUMMARY OF THE INVENTION

In accordance with this invention, there is provided an electrical connector member comprising a generally cylindrical shell member forming a housing for one or more electrical contacts and being provided with means for retaining the connector member on a mating connector member which carries generally radial bayonet pins, the retaining means including an axial passage for receiving each bayonet pin, and being such that the connector member can be coupled to and uncoupled from a mating connector member carrying bayonet pins by a sufficient axial force but is retained in the coupled condition against a weak force in the uncoupling direction, characterised in that the retaining means includes one or more resilient members having one or more at least partially circular portions, each circular portion being accommodated in a respective recess and each recess intersecting with the associated passage such that the portions extend partially into the passage.

BRIEF DESCRIPTION OF THE DRAWINGS

The invention will be described in more detail, by way of example, with reference to the drawings, in which.

DESCRIPTION OF THE PREFERRED EMBODIMENTS

Figure 1:
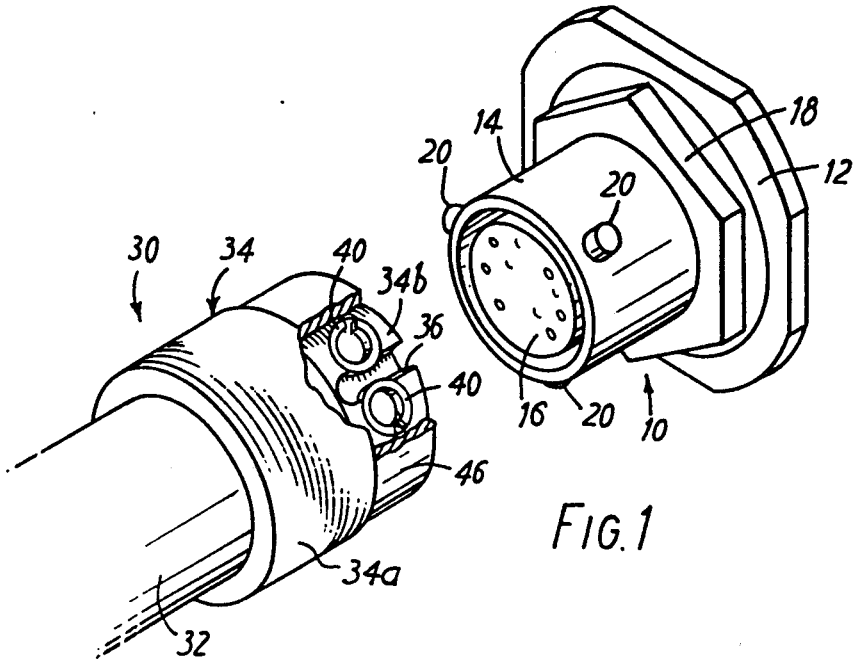
FIG. 1 is a somewhat diagrammatic perspective view of a connector system embodying the invention.

FIG. 1 shows a receptacle 10 which in this instance is mounted in a panel 12. The receptacle has a shell member 14 which forms a housing for a plurality of electrical contacts embedded in an insulator 16. The precise form or number of the contacts is immaterial. The shell member 14 is secured to the panel 12 by means of a nut 18.

The shell member carries three outwardly-projecting bayonet pins 20 equi-spaced around its periphery near to the end of the shell member. Such pins are designed for engagement with a coupling ring on an associated conventional plug connector member. The associated conventional connector member has a key/keyway arrangement to ensure alignment of the two shell members of the respective connector members, and the coupling ring is mounted for a degree of rotary movement on the shell member. To couple the connector system the coupling member is pushed forwardly onto the receptacle and rotated, and uncoupling requires a corresponding counterrotation followed by axial withdrawal.

In accordance with this invention, a preferred plug member 30 comprises a shell member 32 which forms a housing for a contact system which can engage with the contact system on the receptacle 10. As shown the plug member also carries a coupling ring 34 which is conveniently fabricated separately from the shell member 32 but when positioned on the shell member is retained against both axial movement and rotation relative to the shell member.

The coupling ring as shown has a large diameter portion 34*a* rearwardly of a smaller diameter portion 34*b*. The smaller diameter forward portion 34*b* conforms closely to the outer diameter of the receptacle shell member 14 so as to be a close sliding fit over the member 14. The portion 34*b* has three axial slots 36 equi-spaced around its periphery and aligned with the three bayonet pins 20 on the receptacle. The width of the slots 36 is such that the pins form a close sliding fit in the slots.

Figure 2:
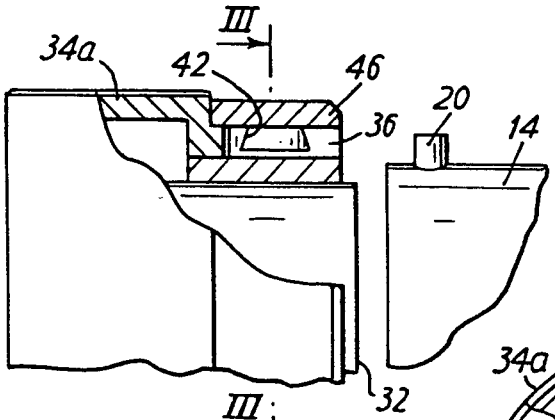
FIG. 2 is a detailed sectional view of the connector system taken on the line II—II in FIG. 3.
Figure 3:
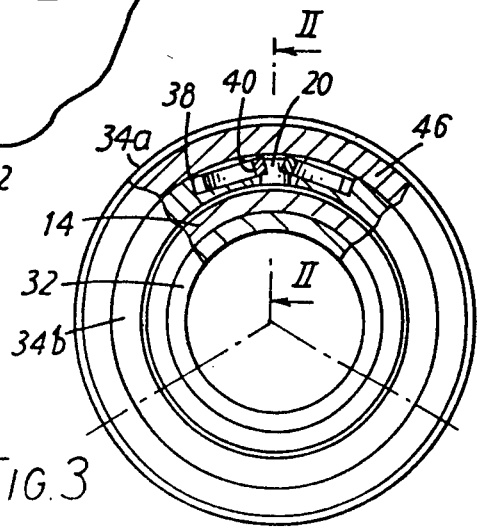
FIG. 3 is a diagrammatic axial section on the line III—III in FIG. 2 of the coupled connector.

As best seen in FIG. 3, two blind bores 38 are formed in the coupling ring to either side of each slot 36 and so as partially to intersect with the slot 36. Each blind bore 38 accommodates a spring ring 40 which projects slightly into the slot 36 as seen in FIGS. 1 and 3. The center lines of the bores 38 are radial with respect to the shell member. The result of this is that the openings 42 from the bores into the slot are trapezoidal as seen in FIG. 2.

Figure 5:
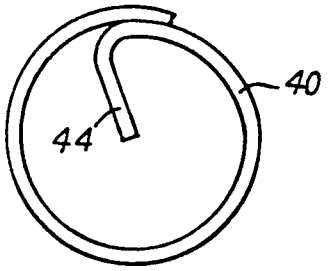
FIG. 5 shows an alternative spring member for use in the connector system of FIG. 1.

The spring rings 40 as shown in FIGS. 1 and 3 are made of spring wire of ribbon type, i.e., of rectangular section, and consist of between one and two complete turns of wire. As shown in FIG. 5 the ring may have an inwardly-directed tang 44 for use in picking the ring up with a pair of pliers or the like. The ring of FIG. 5 is referably made of stainless steel.

The plug member 30 can thus be mounted on the conventional bayonet receptacle 10 by a simple push-on movement applied to the coupling ring 34. The bayonet pins 20 enter the slots 36, and sufficient force is applied to push the pins 20 past the protruding rings 40 to the blind ends of the slots. Here they are retained against a weak uncoupling force by the spring rings 40, but a strong uncoupling force will overcome the spring rings 40 and allow the connector system to uncouple.

The gap between the two spring rings 40 across the slot 36 is less than the width of the bayonet pins 20. The actual degree of projection of the rings into the slot can be quite small, e.g., in a connector of about 15 mm diameter the projection can be of the order of 0.25 mm in a ring 40 of about 2 mm diameter. The required degree of projection for any particular application can be determined empirically.

As seen in FIG. 3, the rectangular section of the rings coupled with the angle of the bores 38 relative to the passage 36 means that the bottom edge of the rings tends to make positive contact with the bayonet pins 20 at the base of the pins.

A retainer ring 46 surrounds the smaller-diameter forward portion 34*b* of the coupling ring to retain the rings 40 in the bores 38.

Figure 4:
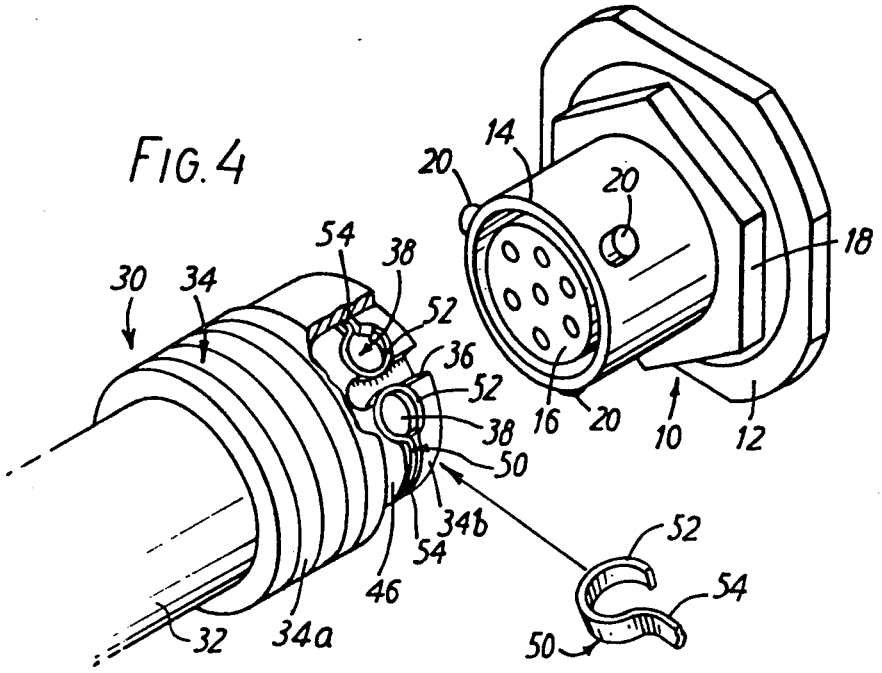
FIG. 4 is a view similar to FIG. 1 of a modified connector system.

FIG. 4 shows a modification in which two of the rings 40 associated with two adjacent passages 36 are replaced by a single member 50 (FIG. 4 showing a fragmentary view of an end portion) of ribbon (rectangular) cross-section which has two part-circular end portions 52. The end portions 52 are linked by a section 54 which runs around a groove in the coupling ring. The shape of the end portions 52 is such that the force needed to push the bayonet pins past the portion 52 is less in the coupling direction than in the uncoupling direction. On the other hand, the modification overcomes a possible problem with the arrangement of FIG. 1 where the rings 40 can rotate in the bores 38 and cause random variation in the use in the axial force required for coupling and uncoupling due to differences in the rotational orientation of the ends of the wire forming the spring rings. Alternatively, the rings 40 could be provided with an outwardly-directed tang to engage in a recess in the coupling ring so as to stop rotation of the rings 40.

Figure 6:
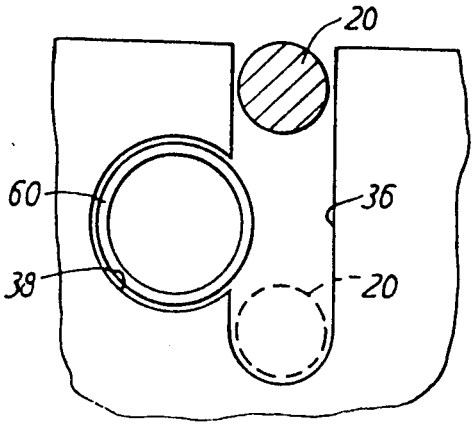
FIG. 6 is a developed view of part of the periphery of the shell member of another connector embodying the invention.

FIG. 6 illustrates a further modification in which a single ring 60 is used in place of the two rings 40. The degree of interference into the slot is adjusted to provide sufficient resistance to coupling and uncoupling from a single ring. The ring 60 is a continuous plastic ring and so has no discontinuity such as to form variations in the coupling and uncoupling force required upon rotation of the ring 60 in the bore 38.

Figure 7:
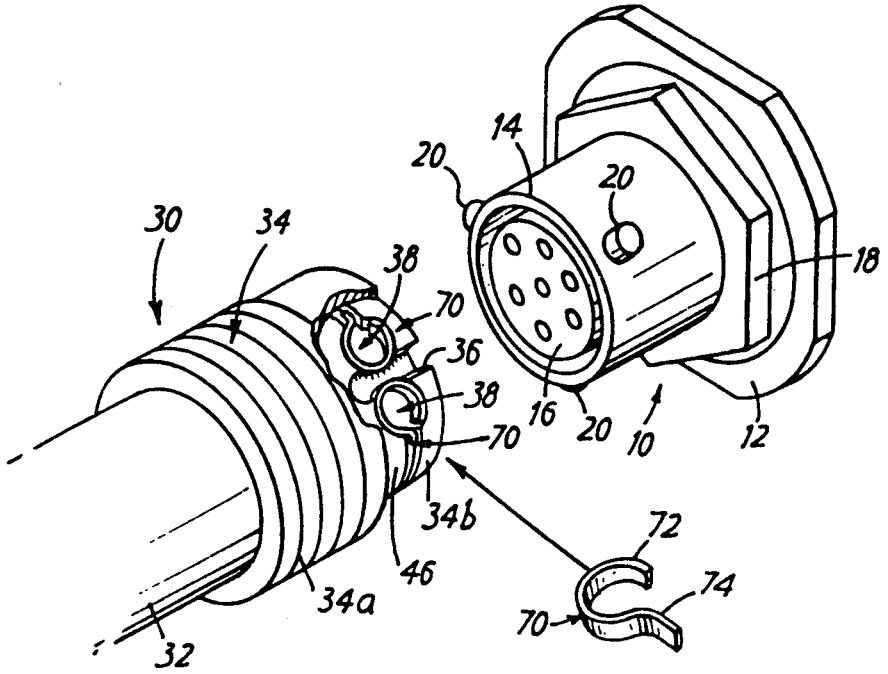
FIG. 7 is a view similar to FIG. 1 of another modified connector system.

FIG. 7 shows a connector system which is identical to the one shown in FIG. 4 with the exception that each member 50 is replaced by a pair of members 70 of "question mark" shape. Each member 70 has a curved portion 72 and a stem portion 74 which is seated in an end portion of the groove around the coupling ring. These members 70 also have the effect of making the coupling force less than the uncoupling force.

The connectors shown in the drawings have the advantage that the circular bores 38 are relatively easy to machine. Furthermore, the same sized ring 40 or 60 or member 70 can be used with a plurality of different sizes of shell member.

Many modifications may be made to the arrangements illustrated. For example, the construction may be radially-reversed for use with inwardly-directed bayonet pins.

We claim:

1. An electrical connector member comprising a generally cylindrical shell member forming a housing for one or more electrical contacts and being provided with means for retaining the connector member on a mating connector member which carries generally radial bayonet pins, the said means including an axial passage for receiving each bayonet pin, and being such that the connector member can be coupled to and uncoupled from a mating connector member carrying bayonet pins by a sufficient axial force but is retained in the coupled condition against a weak force in the uncoupling direction, characterised in that the said means includes a plurality of resilient members each having a plurality of at least partially circular portions, each said circular portion being accommodated in a respective recess and each recess intersecting with the associated passage such that the said portions extend partially into the passage.

2. A connector member according to claim 1, in which the a circular portions are portions of circular spring.

3. A connector member according to claim 1, in which each circular portion is connected to another circular portion by means extending around the periphery of the connector member.

4. A connector member according to claim 1, in which each circular portion is a loop portion of resilient member of question-mark shape having its stem portion seated in a peripheral groove of the connector member.

5. A connector member according to claim 4, in which the loop portion is shaped such that the force required to couple the connector member onto a mating connector member is different from the force required to uncouple the members.

6. A connector member according to claim 1, in which the circular portions are portions of circular rings of moulded plastics material.

7. A connector member according to claim 1, in which the circular portions are portions of circular rings having inwardly-directed radial portions thereon to facilitate handling of the rings.

8. A connector member according to claim 1, in which the circular portion has a substantially rectangular cross-section.

9. A connector member according to claim 1 wherein each resilent member comprises a pair of circular springs, said springs being located on opposite sides of said passage.

10. An electrical connector member comprising a generally cylindrical shell member forming a housing for one or more electrical contacts and being provided with means for retaining the connector member on a mating connector member which carries generally radial bayonet pins, the said means including an axial passage for receiving each bayonet pin, and being such that the connector member can be coupled to and uncoupled from a mating connector member carrying bayonet pins by a sufficient axial force but is retained in the coupled condition against a weak force in the uncoupling direction, characterised in that the said means includes one or more resilent members having one or more at least partially circular portions, each said circular portion being accommodated in a respective recess and each recess intersecting with the associated passage such that the said portions extend partially into the passage; wherein each circular portion is connected to another circular portion by means extending around the periphery of the connector member.

11. An electrical connector member comprising a generally cylindrical shell member forming a housing for one or more electrical contacts and being provided with means for retaining the connector member on a mating connector member which carries generally radial bayonet pins, the said means including an axial passage for receiving each bayonet pin, and being such that the connector member can be coupled to and uncoupled from a mating connector member carrying bayonet pins by a sufficient axial force but is retained in the coupled condition against a weak force in the uncoupling direction, characterised in that the said means includes one or more resilent members each having a one or more at least partially circular portions, each said circular portion being accommodated in a respective recess and each recess intersecting with the associated passage such that the said portions extend partially into the passage; wherein each circular portion is a loop portion of resilent member of question-mark shape having its stem portion seated in a peripheral groove of the connector member.

12. A connector member according to claim 11, in which the loop portion is shaped such that the force required to couple the connector member onto a mating connector member is different from the force required to uncoupled the members.

* * * * *